US005616166A

United States Patent [19]

Fujita et al.

[11] Patent Number: 5,616,166

[45] Date of Patent: Apr. 1, 1997

[54] TAPPING METHOD FOR BLAST FURNACE

[75] Inventors: Masao Fujita; Osamu Iida, both of Kurashiki, Japan

[73] Assignee: Kawasaki Steel Corporation, Hyogo-ken, Japan

[21] Appl. No.: 495,466

[22] PCT Filed: Dec. 27, 1994

[86] PCT No.: PCT/JP94/02240

§ 371 Date: Jul. 26, 1995

§ 102(e) Date: Jul. 26, 1995

[87] PCT Pub. No.: WO95/18237

PCT Pub. Date: Jul. 6, 1995

[30] Foreign Application Priority Data

| | | | |
|---|---|---|---|
| Dec. 28, 1993 | [JP] | Japan | 5-336077 |
| Dec. 28, 1993 | [JP] | Japan | 5-336078 |
| Dec. 28, 1993 | [JP] | Japan | 5-336079 |

[51] Int. Cl.[6] ..... C21B 7/14

[52] U.S. Cl. ..... 75/387; 75/467; 266/45; 266/46; 222/590; 222/592

[58] Field of Search ..... 75/387, 467; 266/45, 266/46; 222/590, 592

[56] References Cited

U.S. PATENT DOCUMENTS

| | | | |
|---|---|---|---|
| 3,767,090 | 10/1973 | Sundberg et al. | 222/594 |

FOREIGN PATENT DOCUMENTS

| | | | |
|---|---|---|---|
| 0234536 | 2/1987 | European Pat. Off. . | |
| 2110401 | 10/1971 | Germany | 266/237 |
| 55-99580 | 7/1980 | Japan . | |
| 58-6385 | 2/1983 | Japan . | |
| 6-25372 | 4/1994 | Japan . | |
| 6271911 | 9/1994 | Japan | 266/46 |
| 56-43274 | 10/1995 | Japan . | |
| 76461 | 6/1977 | Luxembourg . | |

OTHER PUBLICATIONS

Patent Abstract of Japan, 57–041879, vol. 6, No. 113 (Jun. 1982).

Patent Abstract of Japan, 58–039718, vol. 7, No. 118 (May 1983).

Patent Abstract of Japan, 57–152414, vol. 6,. No. 257 (Dec. 1982).

Patent Abstract of Japan, 57–041878, vol. 6,. No. 113 (Jun. 1982).

*Primary Examiner*—Melvyn Andrews

*Attorney, Agent, or Firm*—Staas & Halsey

[57] ABSTRACT

In tapping method in which molten iron (16) and molten slag (18) are discharged from a blast furnace, a conducting pipe (30) is connected to the external side of a molten iron taphole (12), and an electromagnetic energy supply body (32) is disposed around the outer periphery of the conducting pipe (30), whereby a turning motion or a magnetic pressure due to an electromagnetic repulsive force to the molten iron flowing in the conducting pipe (30) for separating the molten iron (16) from the molten slag (18) thus controlling the discharge rates thereof. With this tapping method, it becomes possible to keep substantially constant the discharged amounts of molten iron and molten slag from the blast furnace during a period from the starting to the completion of the tapping and significantly reduce the number of drilling/blocking upon tapping, and hence to stabilize quality of products and save the tapping work.

13 Claims, 16 Drawing Sheets

TAPPING METHOD FOR BLAST FURNACE

TECHNICAL FIELD

The present invention relates to a tapping method for a blast furnace, which is adapted to discharge molten iron and molten slag, as products obtained by a blast furnace, from a molten iron taphole of the blast furnace.

BACKGROUND ART

Upon tapping, molten iron and molten slag produced in the furnace bottom of a blast furnace are discharged from a molten iron taphole to a molten iron runner. According to a prior art tapping, although the diameter of a molten iron taphole is small at the beginning of tapping, the bore (cross-section) of the molten iron taphole is increased with the progress of the tapping, and the discharge rates of molten iron and molten slag are acceleratedly increased. As a result, in the tapping process, the discharge rates of molten iron and molten slag get ahead of the production rates of molten iron and molten slag, and thereby the surfaces of molten iron and molten slag stored in the furnace bottom are lowered. As the surface levels of molten iron and molten slag stored in the furnace bottom are lowered with the increased discharge amounts thereof and the upper surface level of molten slag reaches the inner level of the molten iron taphole, a furnace gas comes to be jetted from the molten iron hole, thus making is difficult to continue the discharge of molten iron and molten slag. In such a stage, the molten iron taphole is blocked for completing the tapping, and another molten iron taphole is drilled, to thus starting the subsequent tapping. Conventionally, the tapping time using one molten iron taphole is in the range of from 2 to 4 hours, and at this time interval, the tapping is alternately performed using a pair of molten iron tapholes.

The tapping works according to the prior art has the following disadvantages:

(1) The tapping works include extremely heavy works such as a work for drilling or blocking a molten iron taphole; a work for repairing an molten iron runner or a molten slag runner; and a preliminary work for repeated tapping. These tapping works are expected to be reduced; however, the tapping time through one molten iron taphole is limited to 2 to 4 hours due to wear of mud, and accordingly a pair of molten iron tapholes must be alternately used. As a result, two groups of operators must be engaged in the tapping works, thus obstructing the labor-saving.

(2) A molten iron preliminary treating equipment in a casting bed and a slag granulating treating equipment for processing molten slag require the equipment abilities corresponding to the maximum values of molten iron and molten slag at the end of tapping, which are excessively large as compared with the average abilities.

(3) Since the discharge rates of molten iron and molten slag can be adjusted only by changing the diameter of a drill or a metal bar used for drilling a molten iron taphole, they are determined depending on the wear amount of mud forming the molten iron taphole. Consequently, when the discharge rates of molten iron and molten slag are excessively low, the surface levels of molten iron and molten slag in the furnace are abnormally increased, thus leading to instable operation. On the contrary, when the discharge rates thereof are excessively high, there arise troubles due to the lack of processing abilities in a molten iron preliminary treatment, slag granulating treatment, and the like.

(4) In the tapping works using a drill-tapper and mud gun, there arises 5 to 10% of the percent defective in drilling and in drying of mud even using highly mechanized drill-tapper and mud gun, to cause non-steady works, thus making it further difficult to achieve the labor-saving for the tapping work.

(5) Since the tapping works are performed in a batch process using two molten iron tapholes, a variation in quality of molten iron such as a molten iron temperature and the composition of molten iron is large, thus causing an inconvenience in works of a molten iron preliminary treatment performed between an iron-making section and steel-making section.

DISCLOSURE OF THE INVENTION

An object of the present invention is to provide a tapping method for a blast furnace capable of preventing the discharge rates of molten iron and molten slag from a molten iron taphole from being increased in a geometric series with time, and significantly prolonging the tapping time from one molten iron taphole, thereby controlling at constant the discharge rates of molten iron and molten slag to the utmost.

Another object of the present invention is to significantly prolong the tapping time for lowering the tapping number and reducing the tapping work.

A further object of the present invention is to reduce a variation in quality of molten iron by making constant the tapping rate and prolonging the tapping time, and hence to reduce a refining cost necessary for the subsequent molten iron preliminary treatment.

Still a further object of the present invention is to make constant the storing levels of molten iron and molten slag level, and hence to contribute to the safety operation of the blast furnace.

The technical means of the present invention to achieve the above object are as follows:

According to the present invention, there is provided a tapping method for a blast furnace, characterized in that a conducting pipe is connected to the external side of a molten iron taphole of a blast furnace, and molten iron and molten slag are applied with an electromagnetic energy by an electromagnetic energy supply body provided around the outer periphery of the conducting pipe such that either of molten iron and molten slag flowing the conducting pipe is positioned in the center portion of the pipe and the other is position on the peripheral side of the pipe, thereby separating the flows of molten iron and molten slag in the conducting pipe from each other before discharging the molten iron and molten slag.

The electromagnetic energy supply bodies for controlling the layer thickness of molten iron may be disposed around the outer periphery of the conducting pipe at two or more of portions and independently controlled, thereby adjusting the discharge rates of molten iron and/or molten slag.

The rate information obtained by a detecting system for detecting the discharge rates of molten iron and molten slag may be fed back to the electromagnetic energy supply body, thereby controlling the discharge rates of molten iron and/or molten slag. Preferably, the discharge rate of molten iron is measured by a flow rate measuring device provided over a molten iron runner of a casting bed or a weight measuring device provided on a torpedo car while the discharge rate of molten slag is measured by a flow rate measuring device provided over a molten slag runner, and the rate information thus obtained is fed back to the electromagnetic energy supply body, thereby controlling the discharge rates of molten iron and/or molten slag.

An electromagnetic energy may be applied to molten iron and molten slag to impart turning motions crossing the flows of the molten iron and molten slag to the molten iron and molten slag, so that before discharge, the molten iron is positioned on the outer peripheral side of the cross-section of the flow by a centrifugal force, and the molten slag is position on the center side. In this case, the turning rate of molten iron may be controlled, so that the layer thickness of the molten iron positioned on the inner surface side of the conducting pipe is adjusted in accordance with the magnitude of the centrifugal force due to the turning motion, thereby controlling a ratio between the discharge rates of the molten iron and molten slag.

Moreover, according to the present invention, there is provided a tapping method for a blast furnace, characterized in that an electromagnetic energy is applied to molten iron flowing in the conducting pipe to impart a magnetic pressure due to an electromagnetic repulsive force to the molten iron, so that the molten iron is collected at the center portion of the conducting pipe and molten slag is positioned at the peripheral portion of the molten iron. With this means, the flow of the molten iron flowing the conducting pipe can be contracted, thus adjusting the transverse cross-section of the flow of the molten iron. Moreover, the cross-section of the flow of the molten iron may be adjusted, thus controlling the discharge rates of molten iron and molten slag.

Preferably, molten slag is shifted on the outer peripheral side of the flow and the conducting pipe is exteriorly cooled for allowing a solidified layer of molten slag to be stuck on the inner surface side of the conducting pipe, thereby forming a self-lining layer. At this time, the heat release amount due to cooling may be adjusted to change the thickness of the solidified layer, thereby controlling the flow rates of the molten iron and molten slag.

The flow of molten iron may be separated from that of molten slag in the conducting pipe, thereby independently discharging the molten iron and molten slag. At this time, the flow rate of molten iron is preferably adjusted to be different from that of molten slag, thereby separating the molten iron from the molten slag on the basis of a difference in the inertia force therebetween.

BEST MODE FOR CARRYING OUT THE INVENTION

Figure 1:
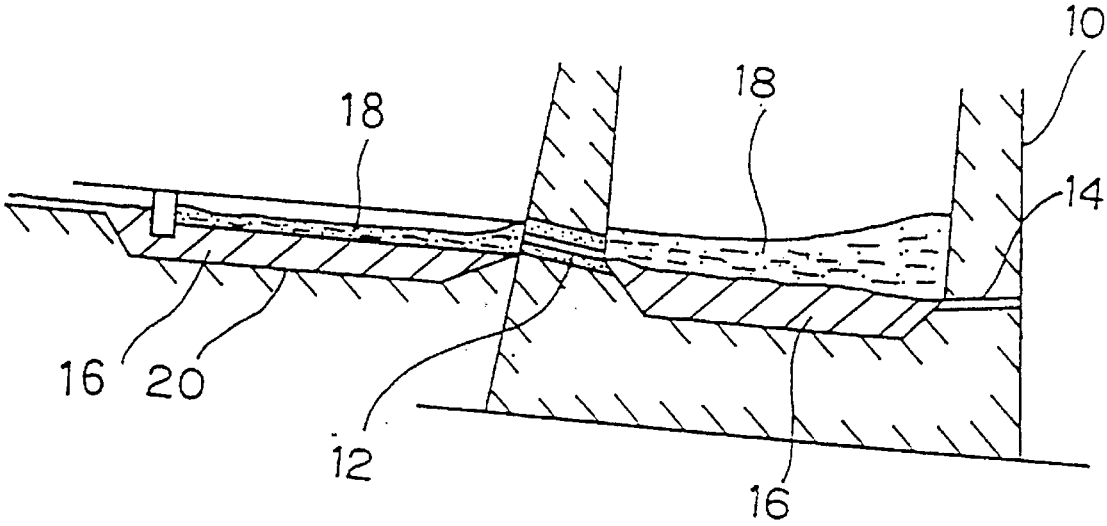
FIG. 1 is a vertical sectional view of a furnace bottom portion of a blast furnace according to a prior art.

Hereinafter, the present invention will be described in detail with reference to the drawings. First, a prior art will be described. As shown in FIG. 1, molten iron 16 and molten slag 18 are stored in a furnace bottom 10 of a blast furnace. Since the molten iron 16 is larger in specific gravity than the molten slag 18, the molten slag 18 is located on the molten iron 16 in a separated state. When the molten iron 16 and molten slag 18 are stored in the furnace bottom 10, a molten iron taphole 12 is drilled and the molten iron 16 and molten slag 18 in the furnace are discharged into a molten iron runner 20 through the molten iron taphole 12.

Figure 2:
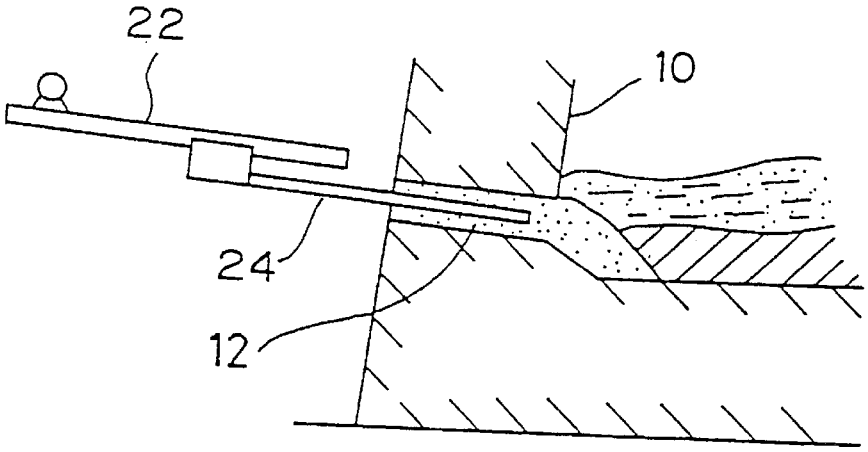
FIG. 2 is a vertical sectional view showing the state of drilling a molten iron taphole according to the prior art.
Figure 3:
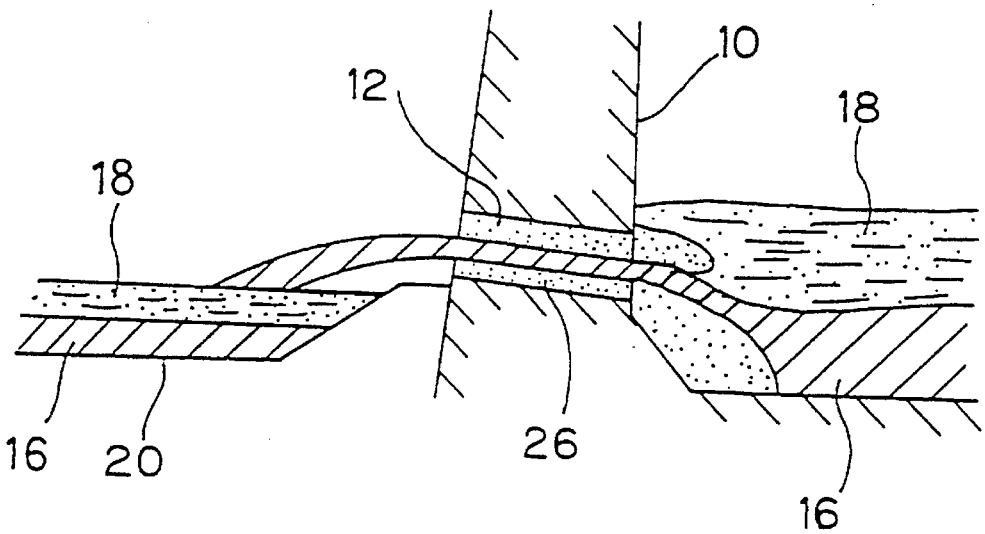
FIG. 3 is a vertical sectional view showing the tapping from the molten iron taphole according to the prior art.

Upon tapping by drilling the molten iron taphole 12 provided in the furnace bottom 10, a drill-tapper 22 is moved in front of the molten iron taphole 12 as shown in FIG. 2, and a drill 24 (or metal bar) mounted on the drill-tapper 22 is driven in the molten iron taphole 12, thus drilling the molten iron taphole 12. After drilling of the molten iron taphole 12, as shown in FIG. 3, the molten iron 16 and the molten slag 18 stored in the furnace bottom 10 are discharged in the molten iron runner 20 through the molten metal taphole 12. The tapping work has been thus performed.

Figure 4:
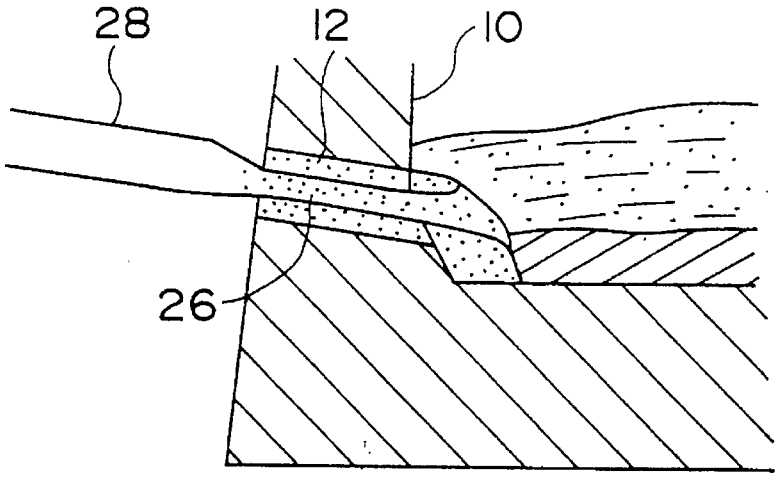
FIG. 4 is a vertical sectional view showing the blocking of the molten iron taphole according to the prior art.

After completion of the tapping from the molten iron taphole 12, as shown in FIG. 4, a mud gun 28 is mounted in the molten iron taphole 12, to press mud 26 in the mud gun 28 into the molten iron taphole 12, to block the molten iron taphole 12, thus stopping the tapping. The mud 26 thus filled in the molten iron taphole 12 is dried and solidified by the heat from the surroundings of the molten iron taphole 12. In the next tapping, the mud 26 thus solidified is drilled again by the drill-tapper 22, thus repeating the tapping.

Figure 5:
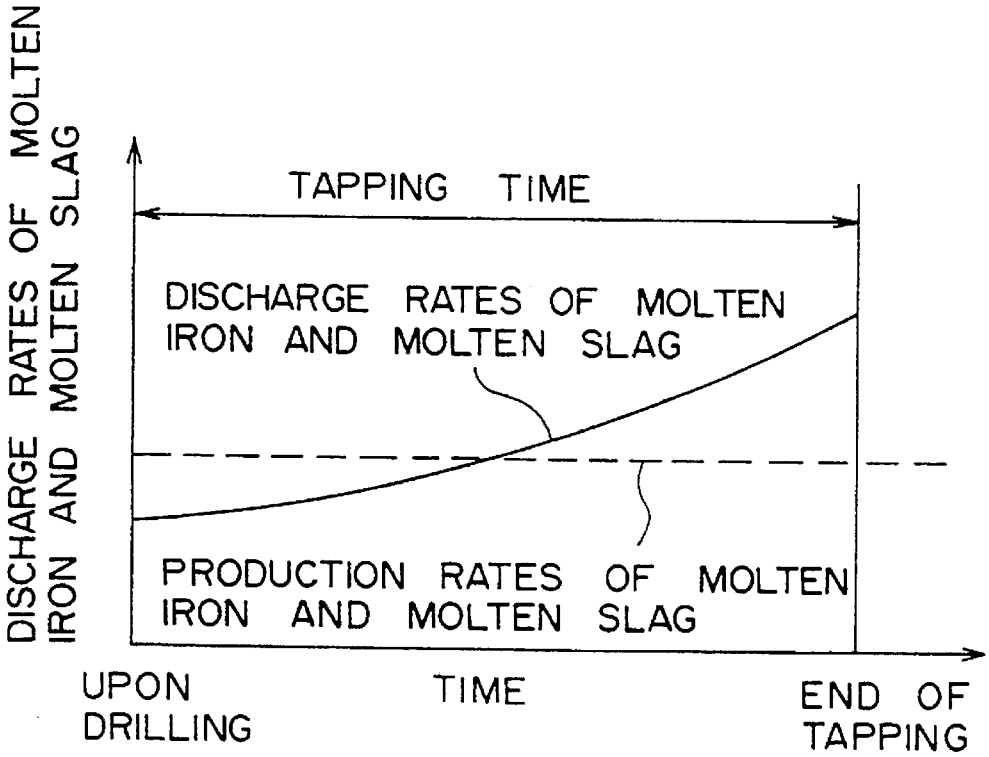
FIG. 5 is a diagram showing the relationship between the discharged rates of molten iron and molten slag and the production rates of molten iron and molten slag.

In the prior art tapping work, at the time directly after the mud 26 filled in the molten iron taphole 12 is drilled by a drill 24 for metal bar) mounted on the drill-tapper 22, the diameter of an opening portion formed in the molten iron taphole 12 is dependent on the outside diameter of the drill 24 (or metal bar). At the beginning of the tapping, molten iron and molten slag are thus discharged through the molten iron taphole 12 having a small diameter, and as shown in FIG. 5, the discharge rates of molten iron and molten flag are smaller than production rates of molten iron and molten slag produced by reduction-melting of iron ore in the blast furnace. Accordingly, in the furnace bottom 10, the surfaces of the molten iron 16 and the molten slag 18 are raised.

However, with the progress of the tapping, the mud 26 forming the molten iron taphole 12 is worn by the discharge of molten iron and molten slag, and consequently, the diameter (cross-section) of the molten iron taphole is gradually enlarged. At the same time, a pressure loss of the molten iron passing through the molten iron taphole 12 is reduced, to thereby increase the discharged amounts of molten iron and molten slag.

Thus, in the tapping process, the discharge rates of molten iron and molten slag get ahead of the production rates of molten iron and molten slag, with a result that the surfaces of the molten iron 16 and the molten slag 18 in the furnace bottom 10 are lowered.

Figure 6:
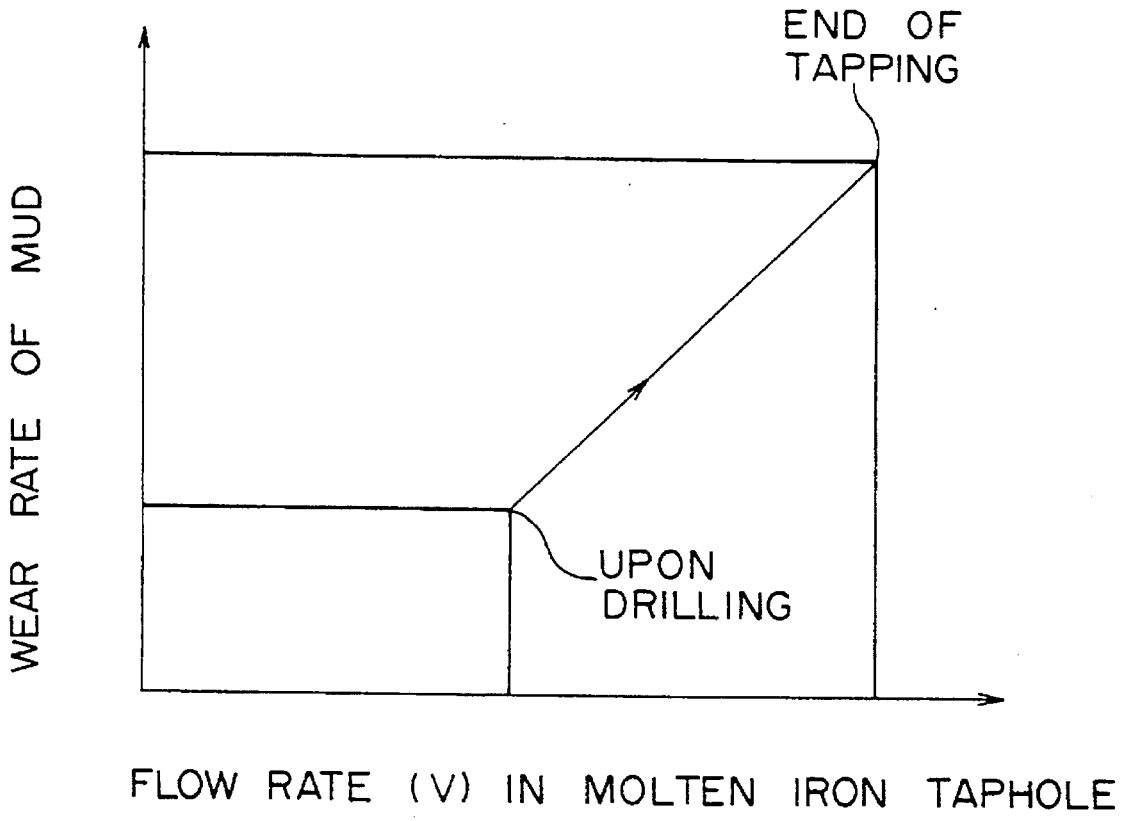
FIG. 6 is a diagram showing the relationship between the wear rate of mud in the molten iron taphole and the flow rates of molten iron and molten slag in the molten iron taphole.

When the discharge rates of molten iron and molten slag during tapping are thus increased, the wear rate of the mud 26 forming the molten iron taphole 12 is increased as shown in FIG. 6, and thereby the discharged amounts of molten iron and molten slag are acceleratedly increased. The surface levels of the molten iron 16 and the molten slag 18 stored in the furnace bottom 10 are lowered due to an increase in the discharged amounts of molten iron and molten slag. Thus, as the upper surface level of the molten slag 18 approaches the inside level of the molten iron taphole 12, a furnace gas is jetted from the molten iron taphole 12, thereby making it difficult to continue the tapping.

In such a state, the mud 26 is filled in the molten iron taphole 12 by the mud gun 28, to block the molten iron taphole 12, thus completing the tapping. Subsequently, another molten iron taphole is drilled using the drill-tapper 22, thus continuing the tapping through the molten iron taphole. In the prior art, the tapping has been alternately performed using a pair of molten iron tapholes.

Figure 7:
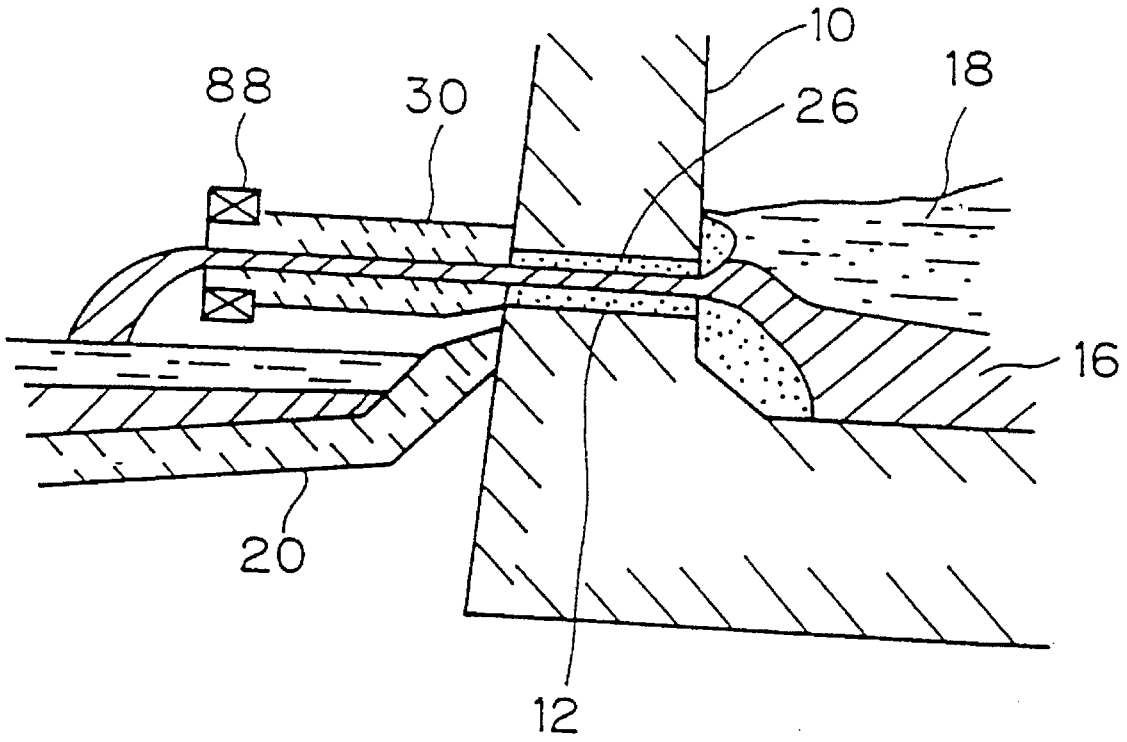
FIG. 7 is an illustrative view of an electromagnetic brake according to the prior art.

There has been required a method capable of solving the above-described problems of the prior art, that is, of significantly prolonging the tapping time and of usually controlling the discharge rates of molten iron and molten slag at constant. A method of satisfying such a requirement has been proposed, in which an electromagnetic brake 88 is disposed at an outlet portion of a conducting pipe 30 as shown in FIG. 7 for controlling the flow rates of molten slag and molten slag in a flow passage. In this method, however, since a furnace pressure of 3 to 5 kg/cm$^2$ in a blast furnace is applied to molten iron and molten slag, the electromagnetic brake 88 requires a large amount of energy against such a pressure, and further it is difficult to independently control the discharge rates of molten iron and molten slag.

In the present invention, a conducting pipe is mounted on the external side of the molten iron taphole, and an electromagnetic energy supply body is provided around the outer periphery of the conducting pipe, wherein an electromagnetic energy is applied to molten iron and molten slag flowing in the conducting pipe, thus adjusting the flows of the molten iron and the molten slag.

Figure 20:
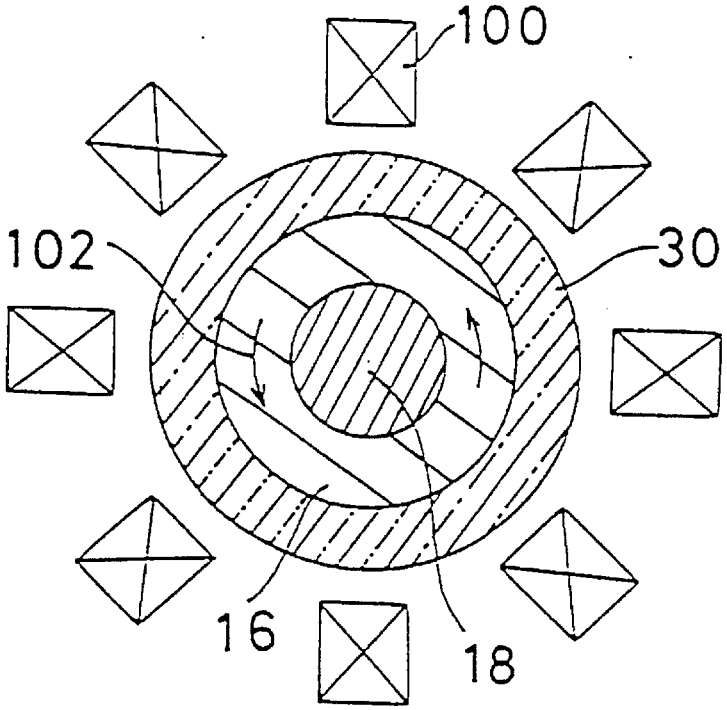
FIG. 20 is an illustrative view showing the principle of the present invention.

The present invention includes two mode of applying an electromagnetic energy. In the first mode, a rotating field crossing the flow of molten iron in the conducting pipe is applied to the molten iron from the exterior of the conducting pipe. As shown in FIG. 20, electromagnetic energy supply bodies 100 for generating a rotating field are disposed around the outer periphery of the conducting pipe 30, wherein the molten iron 16 is applied with the turning shown by the arrow 102 within a cross-section of the flow passage, so that the molten iron 16 is shifted on the outer peripheral side of the conducting pipe 30 and the molten slag 18 is collected at the central portion of the flow. Namely, by applying a rotating field to a conductive material (molten iron), the conductive material is turned by an induced voltage in the conducting pipe on the basis of the same principle as an induction motor. As a result, a centrifugal force is generated, and the flow rate of the molten iron can be adjusted by the magnitude of the centrifugal force. At this time, the molten iron having a large specific gravity is collected on the outer peripheral side, and the molten slag having a small specific gravity is collected at the central portion. The tapping rate can be thus controlled by applying a rotating motion crossing the flow of the molten iron. Accordingly, it is possible to control the discharge rates of molten iron and molten slag at desirable values irrespective of the wear of the mud in a molten iron taphole.

The second mode of applying an electromagnetic energy according to the present invention is characterized by applying a high frequency current to an electromagnetic energy supply body disposed around the outer periphery of a conducting pipe for imparting a magnetic pressure due to an electromagnetic repulsive force to molten iron flowing in the conducting pipe, thus contracting the flow of the molten iron. By this contraction flow of the molten iron, the molten iron flowing in the conducting pipe is collected at the central portion, and the molten slag is shifted on the peripheral side. In this case, the discharge rates of molten iron and molten slag are controlled by adjustment of the cross-section of the flow passage through the magnitude of the magnetic pressure. Accordingly, it is possible to freely control the discharge rates of molten iron and molten slag irrespective of the wear of the mud in a molten iron taphole.

Figure 21:
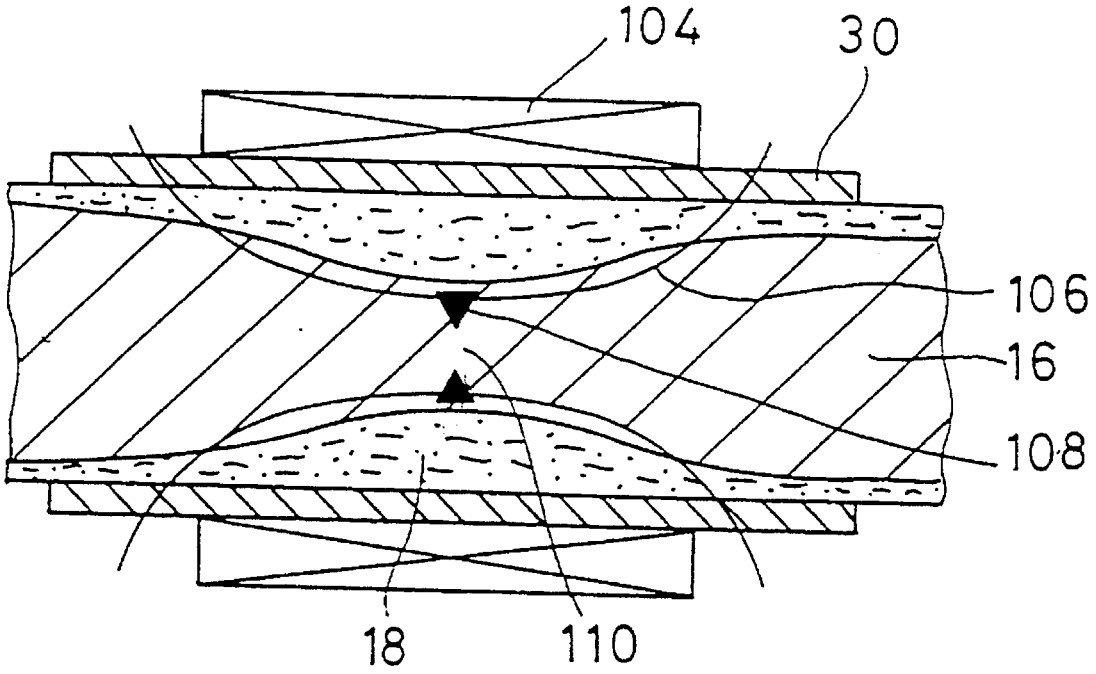
FIG. 21 is an illustrative view showing the principle of the present invention.

One preferable example of imparting a magnetic pressure due to an electromagnetic repulsive force to molten iron is shown in FIG. 21. A magnetic energy supply body 104 is longitudinally disposed around the outer periphery of the conducting pipe 30, wherein a single phase of a high frequency current is applied to the electromagnetic energy supply body 104, to generate a high frequency current. As shown in the figure, a magnetic flux 106 flows along the outer peripheral portion of molten iron, to generate an eddy current on the outer peripheral surface of the molten iron. A magnetic pressure 108 directing in the center direction along the magnetic flux is applied to the outer periphery of the molten iron flowing in the conducting pipe, to generate magnetic levitation, thus forming a contraction flow portion 110. With the formation of the contraction flow portion 110, molten slag 18 not applied with the electromagnetic repulsive force is collected on the outer peripheral side, and thereby the molten iron 16 is separated from the molten slag 18.

Hereinafter, the construction and the function of the present invention will be described in detail with reference to the following examples:

EXAMPLE 1

Figure 8:
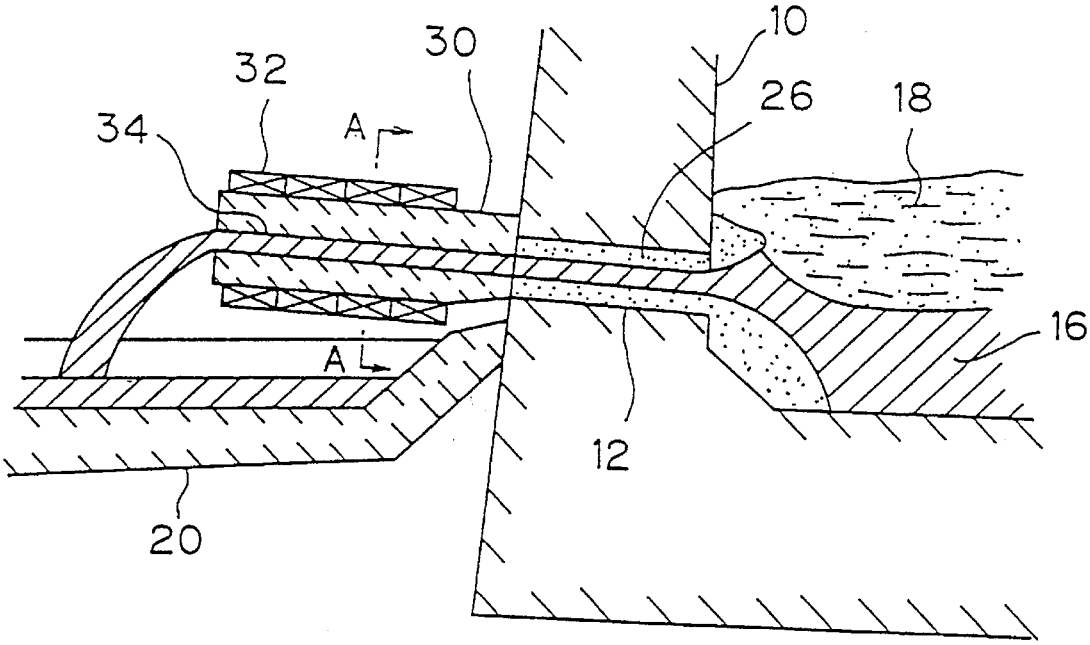
FIG. 8 is a vertical sectional view showing an apparatus according to an embodiment of the present invention.

A conducting pipe 30 is connected to the external side of a molten iron taphole 12 disposed in a furnace bottom 10 as shown in FIG. 8. The mounting of the conducting pipe 30 is not particularly limited, but may be performed, for example, using the means used for mounting a mud gun. At least two electromagnetic energy supply bodies 32 (four pieces, in the figure) are longitudinally disposed around the outer periphery of the conducting pipe 30 in such a manner as to surround the barrel of the conducting pipe 30. When molten iron 16 and molten slag 18 stored in the furnace bottom 10 are discharged through the molten iron taphole 12 and are made to pass through a flow passage 34 formed of refractories in the conducting pipe 30, an electromagnetic force is applied from the electromagnetic energy supply bodies 32 to the molten iron and molten slag for giving a rotating motion crossing the flow of the molten iron and molten slag.

Figure 9:
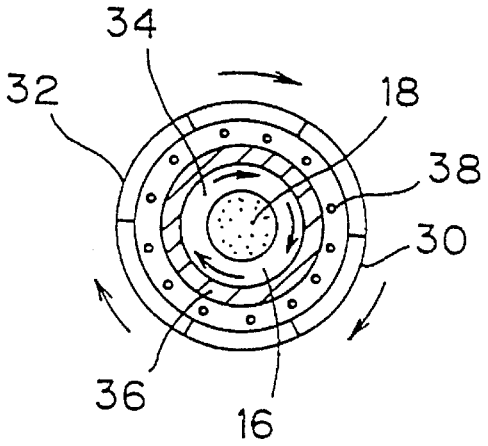
FIG. 9 is a sectional view taken along line A-A of FIG. 1.

FIG. 9 shows the state in which a turning motion is given to the molten iron 16 flowing in the flow passage 34 in the conducting pipe 30. In this case, the molten iron 16 is turned in the flow passage 34 and is positioned on the outer diameter side in the flow passage 34 by the centrifugal force; while the molten slag 18 is necessarily positioned on the center side, thus separating the molten iron 16 from the molten slag 18.

To protect the conducting pipe 30 from the molten iron 16, the inner surface of the conducting pipe 30 is subjected to lining of refractories 36, and is buried with cooling passages 38 for cooling the conducting pipe 30 with a cooling medium such as cooling water passing therethrough.

In general, the main damage of the mud 26 forming the flow passage of the molten iron taphole 12 is the wear due to the molten slag 18. In the conducting pipe 30, the molten slag 18 is positioned on the outside diameter side of the flow passage 34 and the conducting pipe 30 is cooled with the cooling medium passing through the cooling passages 38, so that the wear of the refractories 36 subjected to lining on the inner surface of the conducting pipe 30 can be reduced. This makes it possible to suppress an increase in the discharged amounts of molten iron and molten slag due to the wear of the refractories 36, and hence to prolong the tapping time.

The magnitude of the turning motion of the molten iron 16 can be adjusted by controlling the magnitude of the electromagnetic force imparting the turning motion and the rotational rate of the rotating field. The layer thickness of the molten iron 16 .can be thus controlled, and thereby the flow rates of the molten iron 16 and the molten slag 18 can be controlled.

Figure 10:
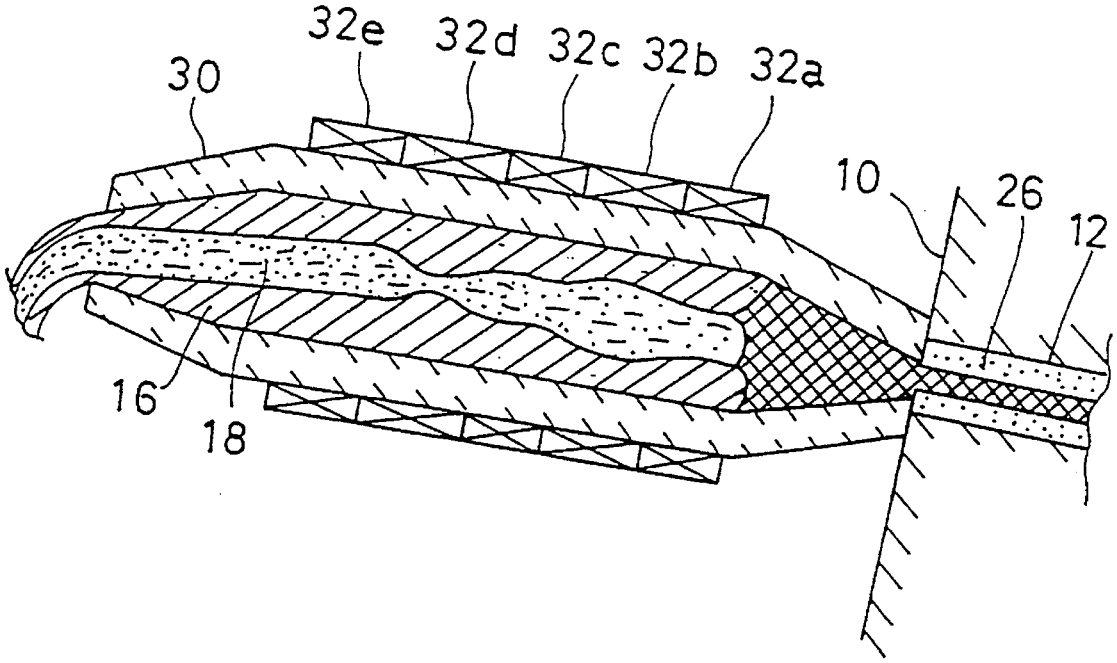
FIG. 10 is a vertical sectional view showing an apparatus according to another embodiment of the present invention.
Figure 11:
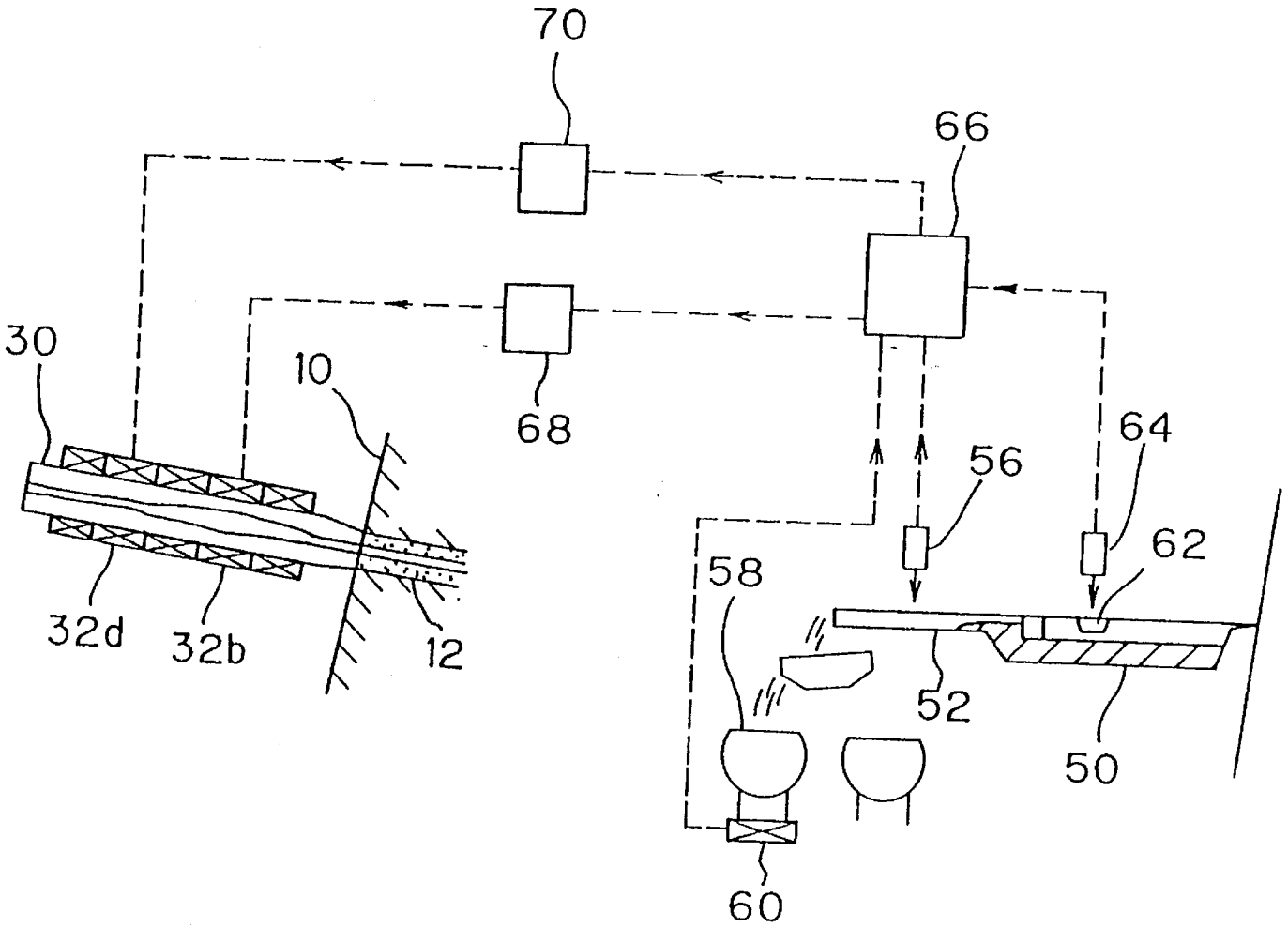
FIG. 11 is a flow chart showing a control system of the present invention.

FIG. 10 shows an example in which five pieces of electromagnetic energy supply bodies 32*a* to 32*e* are longitudinally disposed around the outer periphery of the conducting pipe 30. The electromagnetic energy supply body 32*b* is intended to increase the tuning rate of the molten iron 16 for restricting the layer thickness of the molten iron 16, and hence to control the discharge rate of the molten iron 16. On the other hand, the electromagnetic energy supply body 32*d* is intended to decrease the turning rate of the molten iron 16 for increasing the layer thickness of the molten iron 16 and restricting the cross-section of the flow of the molten slag 18 as a main flow, and hence to control the discharge rate of the molten slag 18.

in this way, by provision of the electromagnetic energy supply bodies at two or more of portions necessary for controlling the layer thicknesses of the molten iron and the molten slag, it becomes possible to independently control the discharge rates of the molten iron and molten slag.

Next, the procedure of controlling the discharge rate of molten iron and the discharge rate of slag through the molten iron taphole 12 will be described.

A controller 68 controls an electromagnetic energy applied to the electromagnetic energy supply body 32*b* disposed around the outer periphery of the conducting pipe 30, to control the discharge rates of the molten iron and molten slag flowing along the inner surface of the conducting pipe 30. On the other hand, a controller 70 controls an electromagnetic energy applied to the electromagnetic energy supply body 32*d* disposed around the outer periphery of the conducting pipe 30, to control the discharge rates of the molten iron and molten slag flowing along the inner surface of the conducting pipe.

The discharge rate of molten iron can be measured by a molten iron flow rate measuring device 56 disposed over a molten iron runner 52 or a weight measuring device 60 provided on a torpedo car 58. On the other hand, the discharge rate of molten slag can be measured by a molten slag flow rate measuring device 64 disposed over a molten slag runner 62. The discharge rate of molten iron obtained by the molten iron flow rate measuring device 56 or the weight measuring device 60, and the discharge rate of molten slag obtained by the molten slag flow rate measuring device 64 are fed to the controller 66, at which each discharge rate is compared with the target value. The control signal necessary for the controllers 68 and 70 is outputted from the controller 66. On the basis of the control signal, an electromagnetic energy applied to each of the electromagnetic energy supply bodies 32*b* and 32*d* is controlled, thus obtaining the specified discharge rate of molten iron.

As described above, molten iron being less in wear against refractories is positioned on the inner surface side of the conducting pipe 30. Accordingly, the conducting pipe 30 is less susceptible to wear as compared with the prior art mud in the molten iron taphole. Thus, the flow passage 34 of the conducting pipe 30 can be kept to have a constant diameter, thereby controlling the tapping rate at constant.

Figure 12:
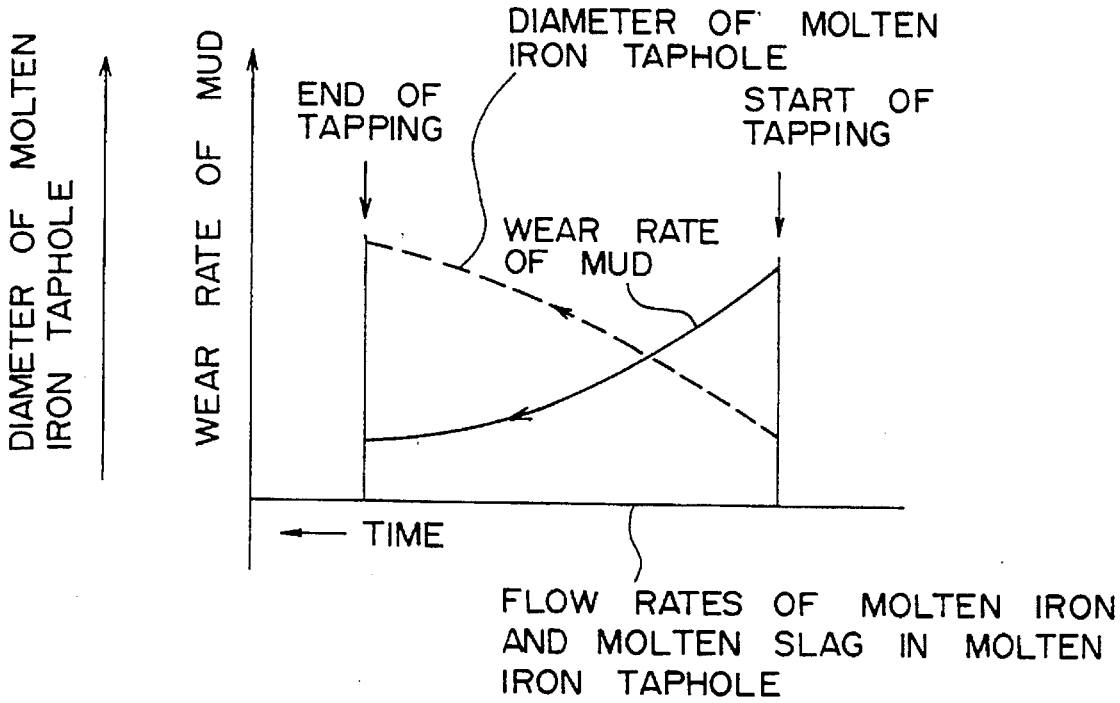
FIG. 12 is a graph showing the relationship between the wear rate of mud in a molten iron taphole and the diameter of the molten hole taphole according to the present invention.

As shown in FIG. 12, the diameter of the molten iron taphole is inevitably increased with time due to the wear of the mud; however, in the present invention, since the discharge rate can be kept constant using the conducting pipe, the flow rate in the molten iron taphole is decreased with an increase in the diameter of the molten iron taphole. As a result, the wear rate of mud forming the molten iron taphole is gradually decreased.

Differently from the prior art in which the wear rate of mud is acceleratedly increased with the progress of the tapping, in the present invention, the tapping time can be significantly prolonged.

EXAMPLE b 2

Figure 13:
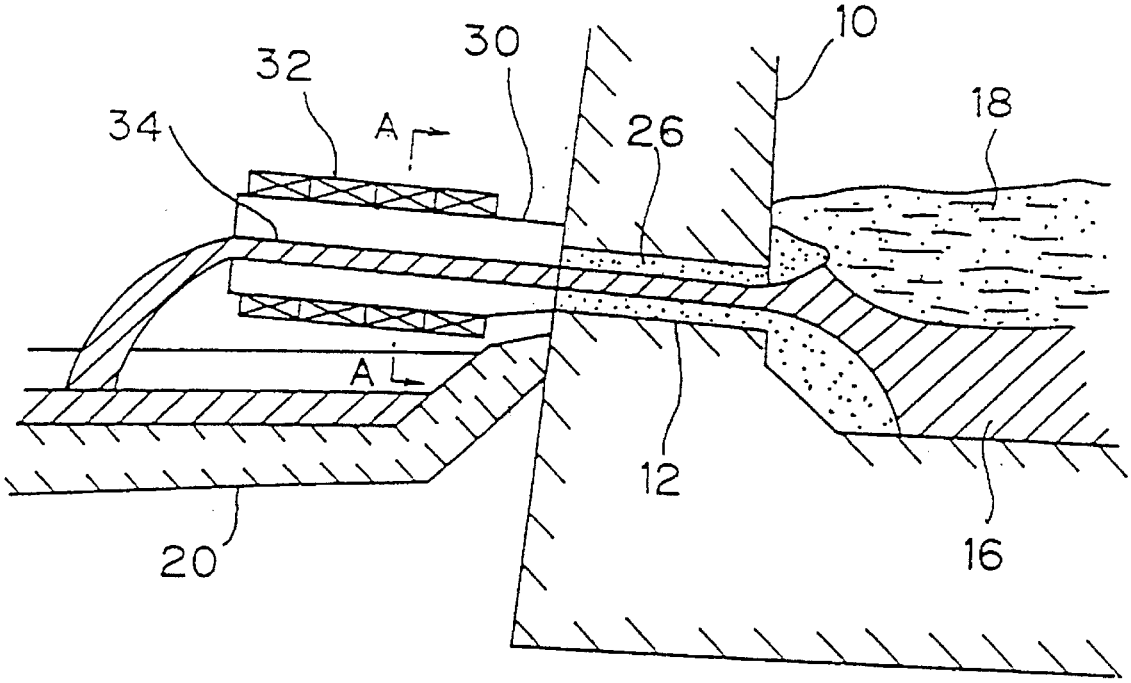
FIG. 13 is a vertical sectional view showing an apparatus in the furnace bottom of a blast furnace according to the present invention.

As shown in FIG. 13, a conducting pipe 30 is connected to the external side of a molten iron taphole 12 disposed in a furnace bottom 10. The mounting of the conducting pipe 30 is not particularly limited, but it may be performed, for example, using the mechanical means used for the mounting a mud gun. A plurality of electromagnetic energy supply bodies 32 (four pieces, in the figure) are longitudinally disposed around the outer periphery of the conducting pipe 30 in such a manner as to surround the barrel portion of the conducting pipe 30.

Figure 14:
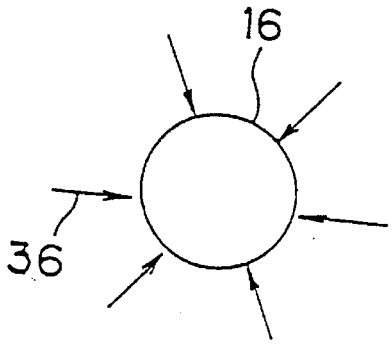
FIG. 14 is an illustrative view showing the state in which the flow of molten iron is contracted by a magnetic pressure applied to the molten iron.
Figure 15:
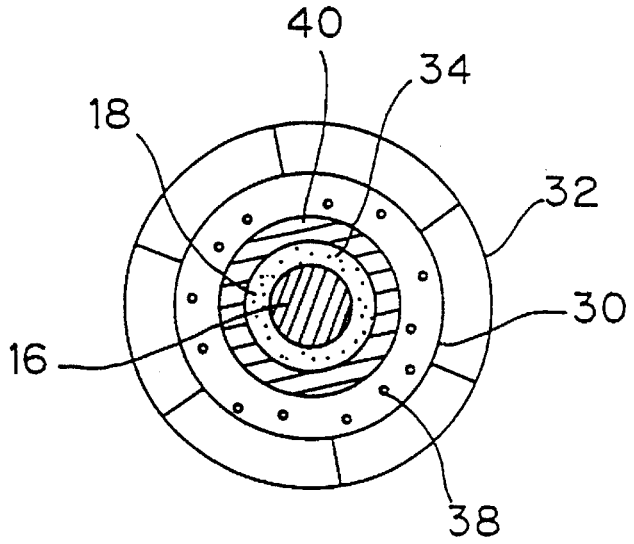
FIG. 15 is a sectional view taken along line A—A of FIG. 13.

When molten iron 16 and molten slag 18 stored in the furnace bottom 10 are discharged through a molten iron taphole 12 and are made to flow in a flow passage 34 in the conducting pipe 30, an electromagnetic energy is applied from the electromagnetic energy supply bodies 32 to the molten iron and molten slag. At this time, the molten iron 16 receives a magnetic pressure 36 due to an electromagnetic repulsive force as shown in FIG. 14. Thus, as shown in FIG. 15, the molten iron 16 is collected at the center portion of the flow passage 34 formed in the conducting pipe 30.

The molten slag 18 is pressed on the outside diameter side in the flow passage 34. As a result, the molten iron 16 at the center portion is separated from the molten slag 18 on the outside diameter side. By cooling the conducting pipe 30 18 with a cooling medium such as water passing through cooling passages 38 provided in the conducting pipe 30, the molten slag 18 is solidified and stuck on the inner wall surface of the flow passage 34 provided in the conducting pipe 30, thus forming the solidified layer. The slag is low in the heat conductivity, and thereby the solidified layer 40 becomes a stable heat-insulating layer, thus forming the self-lining of the conducting pipe 30.

By forming the solidified layer 40 on the inner surface of the conducting pipe 30 by self-lining of the slag as described above, the constant cross-sectional area of the flow passage 34 can be kept because the solidified layer 40 is less susceptible to wear, thus making it possible to keep the discharge rate at constant.

As shown in FIG. 12, with the progress of the tapping work, the diameter of the molten iron taphole 12 is increased due to the wear of mud; however, since the discharge rate can be kept at constant using the conducting pipe 30, the discharge rates of the molten iron and molten slag flowing in the molten iron taphole 12 is decreased. Accordingly, the mud wear rate in the molten iron taphole 12 is gradually decreased. Consequently, differently from the prior art in which the wear of mud is acceleratedly increased with the progress of the tapping, in the present invention, the tapping time can be significantly prolonged.

Figure 16:
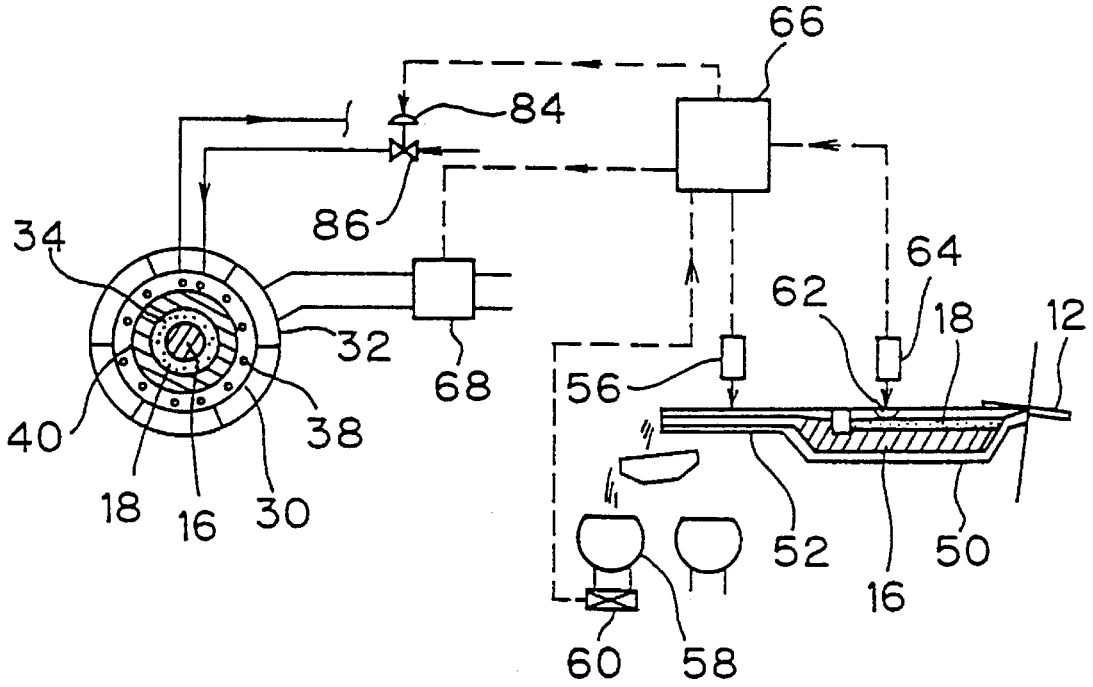
FIG. 16 is a flow chart showing the control system of the present invention.

Next, the procedure of controlling the discharge rate of molten iron and discharge rate of molten slag through the molten iron taphole 12 will be described with reference to FIG. 16.

When the inner wall of the conducting pipe 30 is cooled by a cooling medium such as cooling water flowing in cooling passages 38 provided in the conducting pipe 30, the cooling medium is controlled in its flow rate by a control valve 84, thus adjusting the heat release from the inner wall of the conducting pipe 30. Thus, it becomes possible to control the layer thickness of the solidified layer 40 stuck on the inner surface of the conducting pipe 30, and hence to adjust the cross-section of the flow passage 34 of the conducting pipe 30.

On the other hand, the molten iron 16 at the central portion of the flow passage 34 formed in the conducting pipe 30 is applied with an electromagnetic energy from the electromagnetic energy supply bodies 32, and it receives an electric pressure due to an electromagnetic repulsive force. At this time, the magnitude of the electromagnetic pressure is adjusted by control of the supply amount of the electromagnetic energy by a controller 68, to thus control the cross-section of the flow of the molten iron 16.

The discharge rates of the molten iron 16 and the molten slag 18 can be independently controlled by the adjustment of the cross-section of the flow of the molten iron by the electromagnetic energy supply bodies 32 disposed around the outer periphery of the conducting pipe 30, and by the change in the cross-section of the flow passage 34 through control of the thickness of the solidified layer 40 of the slag formed on the inner wall surface by the cooling of the conducing pipe 30.

The discharge rate of molten iron obtained by a molten iron flow rate measuring device 56 provided over a molten iron runner 52 or a weight measuring device 60 provided on a torpedo car 58 and the discharge rate of molten slag obtained by a molten slag flow rate measuring device 64 provided over a molten slag runner 62 are inputted in a controller 66, at which each discharge rate is compared with the target value. On the basis of the data thus obtained, the controller 66 outputs a control signal to a control valve 84 and the controller 68, to control the opening degree of the control valve 84, thus controlling the flow rate of the cooling medium supplied to cooling furnaces provided in the conducting pipe 30.

In place of the control of the opening degree of the control valve 84, the supply amount of the magnetic energy applied from the electromagnetic energy supply bodies 32 may be controlled, or the flow rate of the cooling medium and the supply amount of the magnetic energy may be simultaneously controlled. By control of the supply amount of the cooling medium to the cooling passages 38 in the conducting pipe 30 and/or the supply amount of the electromagnetic energy applied to the electromagnetic energy supply bodies 32, the specified tapping rate can be obtained by the combination of the adjustment of the thickness of the solidified layer 40 formed on the inner surface of the conducting pipe 30 and the adjustment of the cross-section of the flow of the molten iron 16 present at the center portion of the conducting pipe 30.

The procedure of the present invention will be described with reference to FIGS. 13 and 15. The molten iron taphole 12 is drilled using the prior art drill-tapper. After the start of the tapping from the molten iron taphole 12, the conducting pipe 30 is mounted in the molten iron taphole 12, and an electromagnetic energy is applied from the electromagnetic energy supply bodies 32 as described above, to separate the molten iron 16 from the molten slag 18, and further the conducting pipe 32 is forcibly cooled, thus controlling the tapping rate at constant.

Figure 17:
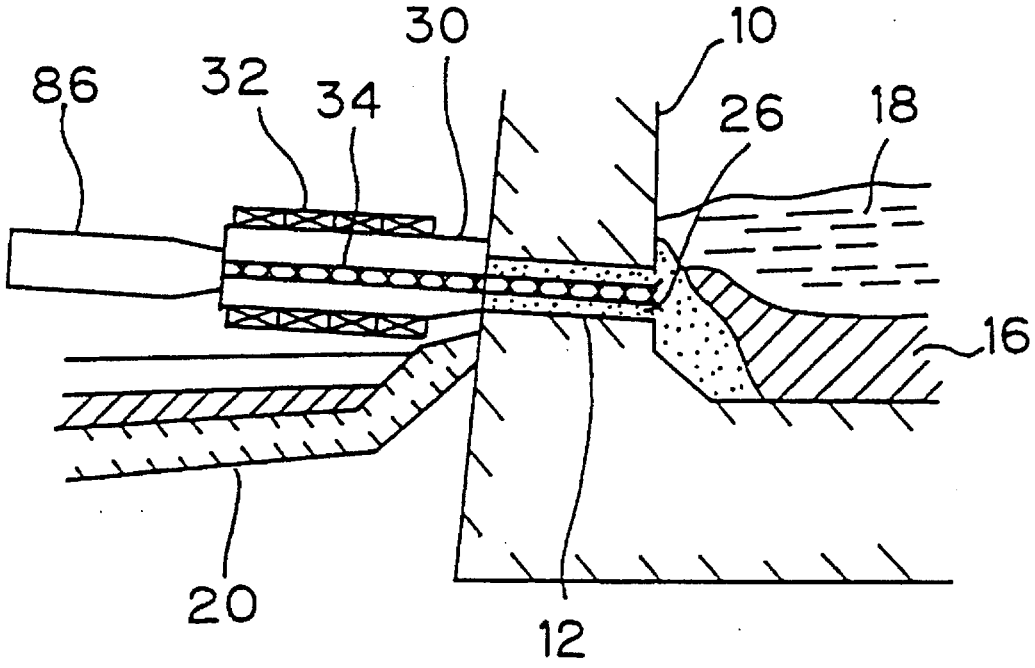
FIG. 17 is a vertical sectional view showing the blocking of a conducting pipe of the present invention using a mud gun.

For example, when the wear of mud 26 forming the molten iron taphole 12 becomes critical, a mud gun 86 is mounted on the external side of the conducting pipe 30 for stopping the tapping as shown in FIG. 17, to fill the furnace with the mud through the conducting pipe 30, thereby blocking the molten iron taphole 12. After that, another molten iron taphole is drilled by the drill-tapper, thus continuing the tapping.

EXAMPLE 3

Like Example 2, a conducting pipe 30 is connected to the external side of a molten iron taphole 12 disposed in a furnace bottom 10. A plurality of electromagnetic energy supply bodies 32 are longitudinally mounted around the outer periphery of the conducting pipe 30.

Similarly to Example 2, by applying an electromagnetic energy, molten iron at the center 16 is separated from molten slag 17 on the outer side of the molten iron 16.

Figure 18:
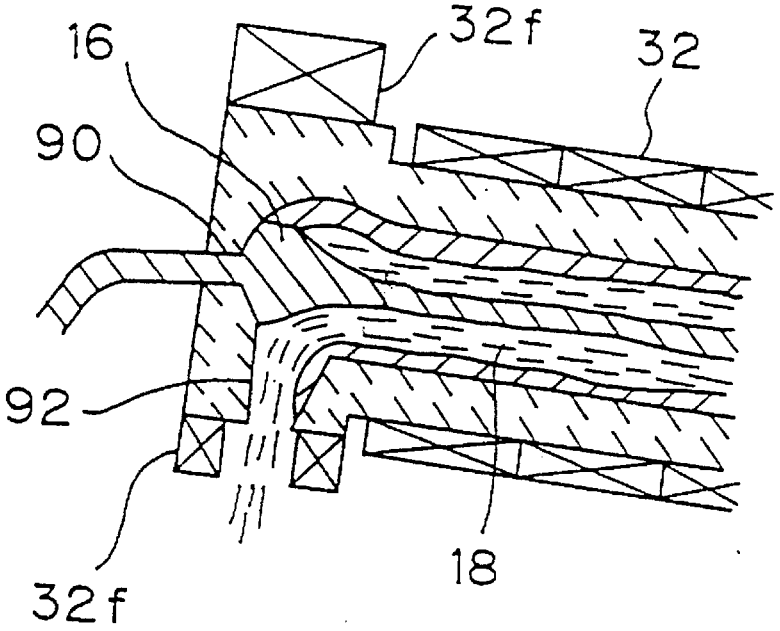
FIG. 18 is a partially sectional view showing the structure of a conducting pipe according to a further embodiment of the present invention.

As shown in FIG. 18, an electromagnetic energy supply body **32*f* is disposed at the discharge end portion of the conducting pipe 30, and a molten iron discharge port 90 and a molten slag discharge port 92** are disposed.

The molten iron 16 is discharged from the molten iron discharge port 90 in the state that the cross-section of the molten iron 16 separated at the center portion and reaching the discharge end portion of the conducting pipe 30 is increased by control of an electromagnetic energy applied from the electromagnetic energy supply body **32*f*. On the other hand, the molten slag 18 shifted on the surrounding portion of the molten iron 16 can be discharged from the molten slag discharge port 92**.

Conventionally, molten iron has been conventionally separated from molten slag by a skimmer provided in a molten iron runner using a difference in specific gravity therebetween; however, in the present invention, it is possible to eliminate the necessity of provision of the skimmer and the molten iron runner, and hence to significantly simplify casting bed equipment and also simplify the tapping works.

Figure 19:
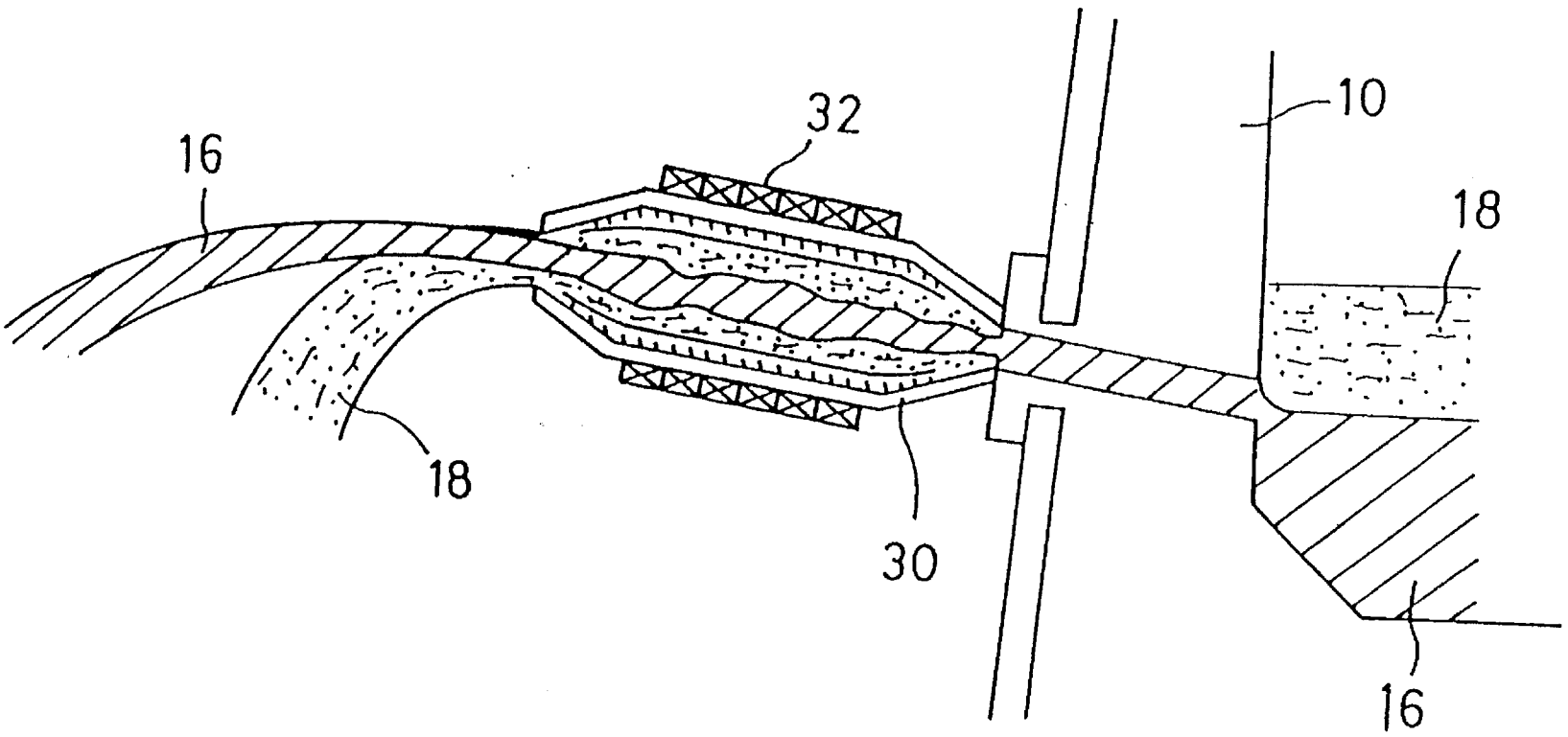
FIG. 19 is a vertical sectional view showing still a further embodiment of the present invention.

FIG. 19 shows an example in which the flow rate of the molten iron 16 is increased near the discharge port of the conducting pipe 30 and the molten iron 16 and the molten slag 18 are simultaneously jetted from the same discharge port, and after the discharge from the discharge port, the molten iron 16 is separated from the molten slag 18 using a difference in flow rate therebetween.

In addition, by provision of a gate (not shown) formed of a ceramic valve body in the molten slag discharge port 92, the discharge of the molten slag 18 can be stopped. The blocking of the molten iron taphole 12 by the mud gun 86 as shown in FIG. 17 can be performed irrespective of the separation of the molten iron from the molten slag.

Differently from that the discharge of the molten iron and molten slag is not directly suppressed by the electromagnetic brake 88 shown in FIG. 7, in this embodiment, the transverse cross-section of the flow of the molten iron is restricted by an electromagnetic pressure by the electromagnetic energy supply bodies 32, to enhance a loss in discharge pressure, thus suppressing the discharge rate. Consequently, it becomes possible to significantly reduce the necessary electromagnetic energy as compared with the electromagnetic brake, and to independently control the discharge rates of the molten iron and molten slag.

INDUSTRIAL APPLICABILITY (1) Since the discharge rates of molten iron and molten slag can be made constant using a conducting pipe, it becomes possible to solve a trouble due to a variation in the discharge rates of the molten iron and molten slag, and hence to reduce work loads necessary for a molten iron preliminary treatment in a casting bed and a slag granulating treatment.

(2) Since the tapping time is significantly prolonged and thereby the number of tapping is significantly reduced, work loads necessary for tapping can be significantly reduced, thus achieving the labor-saving in the tapping works.

(3) Since a variation in quality of molten iron can be significantly reduced by making constant the tapping rate and prolonging the tapping time, it becomes possible to reduce a refining cost necessary for the subsequent molten iron preliminary treatment.

(4) Since the discharge rates of molten iron and molten slag can be adjusted to correspond to production rates of molten iron and molten slag in a blast furnace, it becomes possible to make constant the storing levels of molten iron and molten slag level, and hence to contribute to the safety operation of the blast furnace.

We claim:

1. A method for tapping a blast furnace comprising the steps of:

providing an electromagnetic energy supply body around an outer periphery of a conducting pipe;

connecting said conducting pipe to an external side of a molten iron taphole of said blast furnace;

flowing molten iron and molten slag through said conducting pipe;

applying electromagnetic energy from said electromagnetic energy supply body to adjust the flow of said molten iron and of said molten slag; and discharging said molten iron and said molten slag separately.

2. The method for tapping a blast furnace according to claim 1, wherein either said molten iron or said molten slag is positioned in the center portion of said conducting pipe and the other is positioned on the inner periphery of said conducting pipe upon application of said electromagnetic energy, thereby separating said molten iron and said molten slag from each other upon said discharging.

3. The method for tapping a blast furnace according to claim 1, further comprising the steps of:

providing plural electromagnetic supply bodies around said outer periphery of said conducting pipe, positioned at different locations;

independently controlling each electromagnetic supply body to adjust discharge rates of said molten iron and said molten slag.

4. The method for tapping a blast furnace according to claim 3, further comprising:

detecting said discharge rates using a detecting system to generate discharge rate information; and inputting said discharge rate information into each electromagnetic supply body to control said discharge rates of said molten iron and of said molten slag.

5. The method for tapping a blast furnace according to claim 4, wherein said detecting system comprises a molten iron flow rate measuring device provided over a molten iron runner of a casting bed or a molten iron weight measuring device provided on a torpedo car, and a molten slag flow rate measuring device disposed over a molten slag runner.

6. The method for said tapping a blast furnace according to claim 1, further comprising the steps of:

generating a rotating field crossing the flow of said molten iron upon application of said electromagnetic energy, shifting said molten iron to the inner periphery side of said conducting pipe by a centrifugal force created by said rotating field and;

shifting said molten slag to the center of said conducting pipe.

7. The method for tapping a blast furnace according to claim 6, further comprising:

adjusting a thickness of said molten iron on said inner periphery side of said conducting pipe in accordance with the magnitude of said centrifugal force, thereby controlling a ratio between said discharge rates of said molten iron and said molten slag.

8. A method for tapping a blast furnace according to claim 1, further comprising:

applying a high frequency current to said electromagnetic energy supply body;

imparting a magnetic force due to an electromagnetic repulsive force to said molten iron flowing in said conducting pipe; and decreasing said flow of said molten iron such that said molten iron flows in a central portion of said conducting pipe and said molten slag flows at an inner periphery of said conducting pipe.

9. The method for tapping a blast furnace according to claim 8, further comprising the step of:

adjusting a cross-section of said flow of said molten iron to thereby control said discharge rates of said molten iron and said molten slag.

10. The method for tapping a blast furnace according to claim 8, further comprising the step of:

cooling said conducting pipe to solidify a layer of molten slag upon said inner periphery of said conducting pipe thereby forming a self-lining layer.

11. The method for tapping a blast furnace according to claim 10, further comprising the seep of:

adjusting a heat release amount due to said cooling to change the thickness of the solidified layer of said molten slag to control said flow rates of said molten iron and said molten slag.

12. A tapping method for a blast furnace according to claim 1, further comprising the step of:

separating said flow of molten iron from said flow of molten slag, thereby independently discharging said molten iron and said molten slag.

13. A tapping method for a blast furnace according to claim 12, further comprising the step of:

adjusting said flow rate of molten iron to be different from said flow rate of said molten slag, thereby separating the flow of said molten iron from the flow of said molten slag due to a difference in inertia force between said flow of said molten iron and said flow of said molten slag.

* * * * *